US005584439A

United States Patent [19]

Romagnoli

[11] Patent Number: 5,584,439

[45] **Date of Patent: *Dec. 17, 1996**

[54] PLASTIC CENTRE WHOSE DIMENSIONS CAN BE REDUCED, FOR FORMING SPOOLS OF YARN TO BE DYED

[76] Inventor: Tiziano Romagnoli, Via Machiavelli No. 40, 50047 Prato, Italy

[ * ] Notice: The term of this patent shall not extend beyond the expiration date of Pat. No. 5,435,497.

[21] Appl. No.: 290,183

[22] Filed: Aug. 15, 1994

[30] Foreign Application Priority Data

Aug. 20, 1993 [IT] Italy ..... FI930094 U

[51] Int. Cl.[6] ..... B65H 75/20; D06F 17/00

[52] U.S. Cl. ..... 242/118.11; 68/198

[58] Field of Search ..... 242/118.1, 118.11, 242/604; 68/198

[56] References Cited

U.S. PATENT DOCUMENTS

| | | | |
|---|---|---|---|
| 3,323,174 | 6/1967 | Fallscheer | 68/198 |
| 3,561,697 | 2/1971 | Egyptien | 242/118.11 |
| 3,756,531 | 9/1973 | Draper | 242/118.11 |
| 3,759,461 | 9/1973 | Draper | 242/118.11 |
| 4,454,734 | 6/1984 | Marquis et al. | 242/118.11 X |
| 5,435,497 | 7/1995 | Romagnoli | 242/118.11 |

FOREIGN PATENT DOCUMENTS

| | | | |
|---|---|---|---|
| 0257268 | 3/1988 | European Pat. Off. | 242/118.1 |
| 92/18408 | 10/1992 | WIPO | 242/118.11 |

*Primary Examiner*—Michael R. Mansen
*Attorney, Agent, or Firm*—McGlew and Tuttle

[57] ABSTRACT

A center with elongated slots (3) for reducing axial and transverse sections of the center. The elongate slots (3) are arranged in two series of intersecting helical alignments; on each of these alignments slots are arranged alternately with their greatest dimension along said helical alignment and transversely to it; at each intersection is a slot belonging to both alignments. When an axial compressive force is applied the slots shrink, thereby simultaneously reducing the axial and diametrical dimensions.

18 Claims, 2 Drawing Sheets

PLASTIC CENTRE WHOSE DIMENSIONS CAN BE REDUCED, FOR FORMING SPOOLS OF YARN TO BE DYED

FIELD OF THE INVENTION

The subject of the present invention is a centre which can be made of injection-moulded plastic, is substantially tubular in shape and is designed to receive yarn wound in turns; centres of this kind are intended to undergo various processing operations and in particular dyeing treatments using liquid dye which must penetrate through the turns of the yarn in order to dye it in the most uniform way possible; the spools of yarn wound on the centres are consequently inserted in suitable dyeing equipment in order to carry out the abovementioned operation. In the case of certain yarns especially, the yarn shortens when wetted and heated, which can give rise to high tightening forces being exerted on the centre; for these reasons, it is advantageous for the centre to be able to undergo a reduction in its diameter i.e. in its transverse section, in order to reduce the forces exerted by the yarn and especially to make these forces substantially uniform even deep within the spool, so as to ensure that the mass of yarn wound in turns is dyed in a substantially uniform manner. Centres which allow this reduction in transverse section, i.e. in practical terms a reduction in diameter, are already known but these known centres have certain drawbacks and in particular considerable reduction in the area through which the dyeing liquid can pass through the permeable walls of the centre once it has undergone a reduction in diameter. A further drawback of known centres of this type is that the reduction in diameter often cannot be controlled and can give rise to an excessive undesirable contraction which can lead to additional problems.

A recent type of centre (App. FI92U 102 of Aug. 28, 1992, laid open for public inspection on Feb. 28, 1994 and EP Appl no. 93830308.8 of Jul. 20, 1993, Publish Mar. 16, 1994) is capable of a reduction in the diameter, i.e. the transverse section of the centre, while maintaining a large cross section of the holes that pass through the tubular cylindrical wall of the centre even when its diameter is reduced; it has, on its cylindrical wall, adjacent longitudinal rows of slots which are elongated lengthwise, the slots of one row being staggered—generally by half a pitch—with respect to those of the contiguous rows; in this way the longitudinal edges of each slot can be brought closer together in the intermediate zone, allowing a substantially uniform reduction in the transverse section of the centre when the cylindrical wall of the dentre is subjected to centripetal pressure caused by the tensions induced in the turns of the wound yarn. This centre only allows reductions in diameter, and these reductions in diameter are caused by the tensions created in the turns when wetted by the hot dye.

Centres for the uses indicated above and capable of undergoing axial shortening when pressed during the insertion of a stack of packages into a dyeing or other type of apparatus, are also known.

SUMMARY AND OBJECTS OF THE INVENTION

The present invention allow the diameter to be reduced and, at the same time, allows the axial dimensions to be reduced, with no particular stresses in the yarn, which can be damaged by tension.

The centre according to the invention made from injection-moulded plastic for forming spools of yarn wound about it in turns for processes such as dyeing in particular and for subsequent distribution of the yarn—has, on its cylindrical wall, rows of elongate slots oriented such that the longitudinal edges of at least some of the slots can approach each other in the middle, thereby enabling a reduction in the dimensions of the centre when pressure is applied to the centre's cylindrical wall. The present centre is also characterized in that in the rows of elongate slots, the slots are arranged alternately at at least two angles, in such a way that when the centre is compressed axially and/or radially, the longitudinal edges of at least some of the slots approach each other in the middle, bringing about both a reduction in the axial dimension and a reduction in the transverse section of the centre.

In practice, the rows of elongate slots may be arranged in intersecting helical alignments, on each of which alignments slots are arranged alternately with their greatest dimension along said helical alignment and transversely to it, while at each intersection is a slot belonging to both alignments. The helical alignments may intersect at approximately 90° with respect to each other.

In practice, inserting a stack of reels into a dyeing apparatus, and pushing axially on the centres as they lie on top of each other, simultaneously brings about a linear shortening of the height of the stack of centres and a reduction in their diameter, with no tensions in the yarn.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
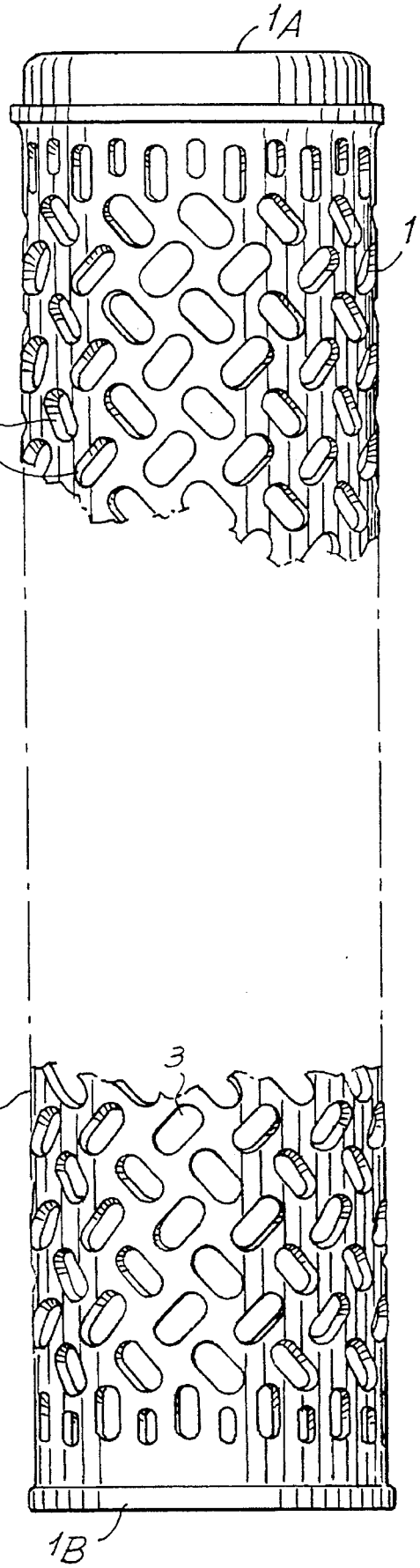
FIG. 1 is a front external view of the center according to the invention, before undergoing contraction in length and transverse section as a result of axial compression.
Figure 3:
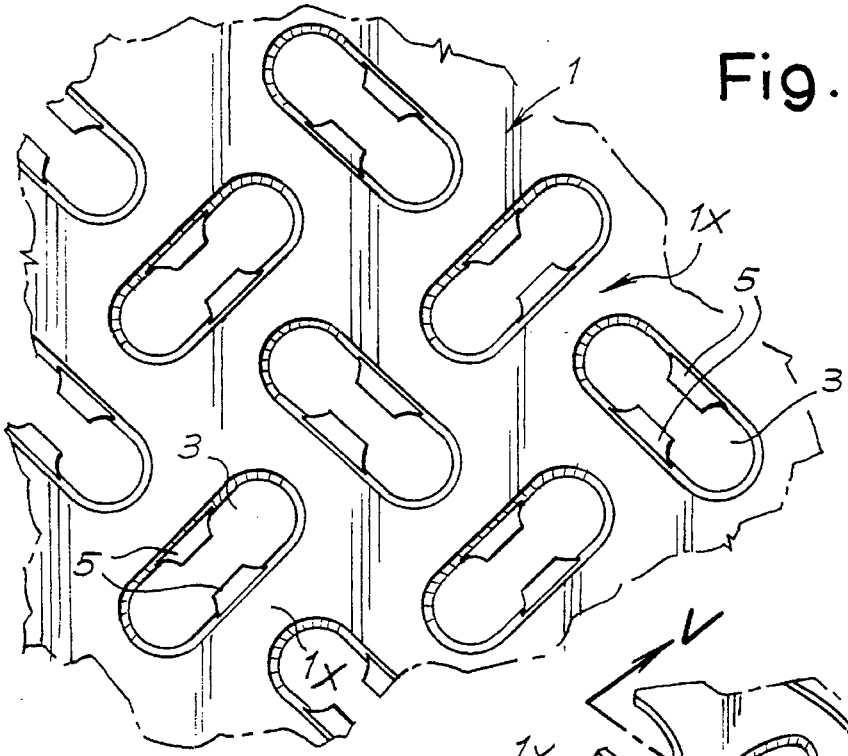
FIG. 3 is a detailed view showing the surface of the center before deformation as a result of axial compression.
Figure 5:
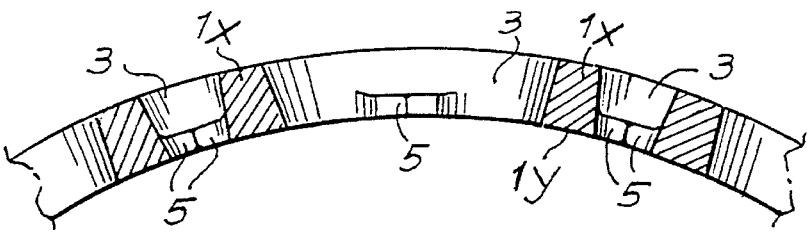
FIG. 5 shows a local section taken along the line V—V indicated in FIG. 4.

As illustrated in the drawing, the numeral 1 in FIG. 1 indicates the complete centre, which is cylindrical in shape with a stepped end 1A and an end 1B shaped for centring on the rim 1A of the next centre down, in an arrangement which is known per se; one of the ends may also be shaped to form a reserve of yarn. The wall characteristically has two series of helical rows of elongate slots 3. The angle of the helical rows of one series is the opposite of that of the helical rows of the other series, so that the rows of the two series intersect; the angles of the helixes are preferably equal and opposite and may each be 45° giving a 90° intersection, in the moulded and undeformed centre. Each slot is elongate and therefore has two longitudinal edges, which originally are a certain distance apart and may comprise an intermediate portion that is straight. Each helical row of slots alternately has one slot lying longitudinally and one slot lying transversely relative to the helical line; a slot 3 lies at the intersection between two helical lines and is longitudinal for one row and transverse for the other row; each transverse slot is preferably positioned symmetrically with respect to the helical line of the row of slots 3 to which it belongs. In an intermediate position along each of the longitudinal sides of each of the slots 3 there may be projections 5 (see FIGS. 3 and 5)—shown in the drawing as being symmetrically opposite each other in pairs—which in the normal conditions of a new centre (FIGS. 1 and 3) are separated from each other by a distance D. In practice the projections 5 of the slots 3 of one helical row of slots correspond to the helical axis of the helical row of slots which it intersects. The projections 5 are set back from the outer surface of the centre, marked 1X in FIG. 5; in practice the projections 5 may be flush with the inner surface 1Y of the cylindrical wall of the centre.

The centre is designed to have wound on it a spool of yarn intended for handling operations, and especially dyeing. The liquid dye is generally introduced into the interior of a stack of centres, i.e. a stack of spools, and has to pass through the mass of turns of yarn in order to dye it.

Figure 2:
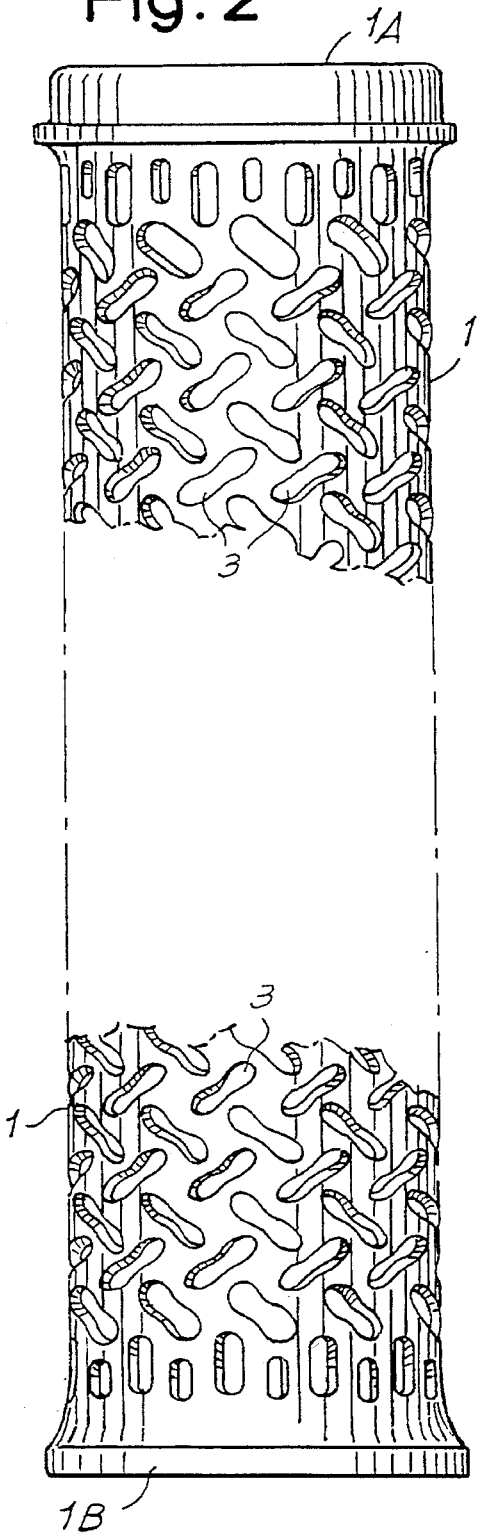
FIG. 2 is a front external view of the center FIG. 1 after undergoing contraction and length and transverse section as a result of axial compression.
Figure 4:
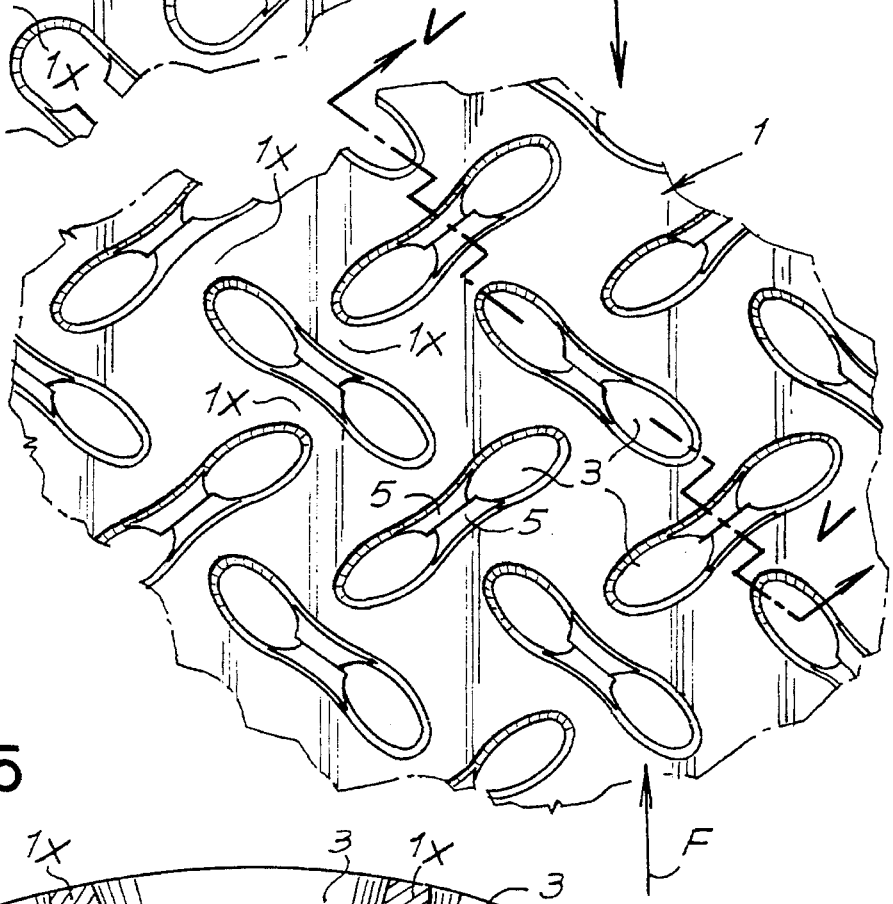
FIG. 4 is a detailed view of the surface of the center after the deformation as a result of axial compression.

In dyeing apparatuses, many centres 1 with their spools of yarn are placed on a centre guide column through which the liquid dye is passed; the apparatus is often provided with means which axially clamp together the centres mounted on the column. These means are used to bring about the deformation of all the centres installed on one column; with the present centre, this deformation takes the form of a reduction in the axial dimension of the centre and a simultaneous reduction in the transverse section, i.e. the diametrical dimension, of the centre, with a certain slackening of yarn wound around the centres, which yarn can thus shorten with no real tension during the dyeing or other treatments. The axial compression deforms the centre—as can be seen by comparing FIGS. 1 and 2 and also by comparing FIGS. 3 and 4—both axially and radially. This brings together and axially compresses the spools of the stack of centres; it also allows the wound yarn to shorten. The deformations produced by the axial compression of the centre (in the direction of arrows f in FIG. 4) causes the longitudinal edges of the elongate slots to approach each other with the result that the projections 5 tend to come together and reduce the dimension D between the confronting extremities of these projections 5. Moreover, at the limit, the extremities of the projections 5 will touch each other and thus eliminate the distance D, but the reduction in the free cross section of the slots 3 is halted at this limit, which represents the maximum reduction of the cross section. The alternate angles and the staggering of the slots 3 of the helical rows of the two series allow the transverse section and axial dimension of the centre to reduce, with a slight deformation of the cylindrical wall. Even when reduced, the elongate slots 3 maintain what is comparatively a very large through cross section, which enables the liquid dye to flow from the interior through the mass of turns of the spool and out (or in the reverse direction).

The projections 5 are set back from the outer surface 1X of the centre, so avoiding any risk of the yarn being pinched by the projections 5 as they close on each other; in practice, the projections 5 are narrower than the thickness of the wall of the centre and are generally flush with the inner surface 1Y of the cylindrical wall of the centre.

The step, such as 1A, or other equivalent arrangement facilitates the centring and stacking of successive centres, avoiding the need for an intermediate separating plate.

I claim:

1. A yarn center, comprising:

a cylindrical wall with axial and transverse section dimensions which can be reduced by mechanical pressure, said wall defining axial and transverse section reduction means including rows of elongate slots defined by said wall including slots with longitudinal edges, said slots being provided oriented in each row at a slot angle, said slot angle alternating from one of said rows to an adjacent one of said rows, said axial and transverse section reduction means for movement of said longitudinal edges of at least some of said slots whereby said longitudinal edges approach each other in a middle of said slots upon axially compressing said yarn center, said axial and transverse reduction means of said wall having a wall surface defining a distance between adjacent slots, said distance being greater between adjacent slots within each of said rows of elongate slots than between adjacent slots of adjacent rows.

2. A yarn center according to claim 1, wherein said rows of elongate slots are arranged in intersecting helical alignments, said slot angle of each of said slots in each of said helical alignments alternating between an orientation with a greatest dimension along said helical alignment and a greatest dimension transverse to said helical alignment, each intersection of said helical alignments including a slot belonging to both of said intersecting helical alignments.

3. A yarn center according to claim 2, wherein said helical alignments intersect at approximately 90° with respect to each other.

4. A yarn center according to claim 1, further comprising a projection projecting into at least some of said slots, each projection acting as a spacer means for limiting a distance said longitudinal edge moves at said middle.

5. A yarn center according to claim 4, wherein said at least some of said slots include an additional projection to provide projections opposite each other to limit a movement of said longitudinal edges.

6. A yarn center according to claim 4, wherein said projections are thinner than a thickness of said wall, said projections being spaced inwardly from an outer surface of said wall.

7. A yarn center, comprising:

a cylindrical wall with axial and transverse section dimensions which can be reduced by mechanical pressure, said wall defining axial and transverse section reduction means including rows of elongate slots defined by said wall including slots with longitudinal edges, said slots being provided oriented in each row at a slot angle, said slot angle alternating from one of said rows to an adjacent one of said rows, said axial and transverse section reduction means for movement of said longitudinal edges of at least some of said slots whereby said longitudinal edges approach each other in a middle of said slots in a compressed state, upon axially compressing said yarn center to achieve axial and transverse section reduction, each of said slots interrupting a surface of said wall to provide a wall surface which has a dimension which varies about the periphery of each slot, said slots of one row being offset with respect to slots of adjacent rows to provide solid areas at art intersection of four slots, said solid area having a greatest dimension between adjacent slots which is greater than a smallest dimension of said slots in a non-compressed state.

8. A yarn center according to claim 7, wherein said rows of elongate slots are arranged in intersecting helical alignments, said slot angle of each of said slots in each of said helical alignments alternating between an orientation with a greatest dimension along said helical alignment and a greatest dimension transverse to said helical alignment, each intersection of said helical alignments including a slot, belonging to both of said intersecting helical alignments.

9. A yarn center according to claim 8, wherein said helical alignments intersect at approximately 90° with respect to each other.

10. A yarn center according to claim 7, further comprising a projection projecting into at least some of said slots, each projection acting as a spacer means for limiting a distance said longitudinal edge moves at said middle.

11. A yarn center according to claim 10, wherein said at least some of said slots include an additional projection to provide projections opposite each other to limit a movement of said longitudinal edges.

12. A yarn center according to claim 10, wherein said projections are thinner than a thickness of said wall, said projections being spaced inwardly from an outer surface of said wall.

13. A yarn center, comprising:

a cylindrical wall with axial and transverse section dimensions which can be reduced by mechanical pressure, said wall defining axial and transverse section reduction means including rows of elongate slots defined by said wall including slots with longitudinal edges, said slots being provided oriented in each row at a slot angle, said slot angle alternating from one of said rows to an adjacent one of said rows, said axial and transverse section reduction means for movement of said longitudinal edges of at least some of said slots whereby said longitudinal edges approach each other in a middle of said slots in a compressed state, upon axially compressing said yarn center, said wall having a wall surface with a solid area between adjacent slots forming a row of slots of said rows of elongate slots with a dimension between said adjacent slots which is greater than a smallest dimension of said slots in a non-compressed state.

14. A yarn center according to claim 13, wherein said rows of elongate slots are arranged in intersecting helical alignments, said slot angle of each of said slots in each of said helical alignments alternating between an orientation with a greatest dimension along said helical alignment and a greatest dimension transverse to said helical alignment, each intersection of said helical alignments including a slot belonging to both of said intersecting helical alignments.

15. A yarn center according to claim 14, wherein said helical alignments intersect at approximately 90° with respect to each other.

16. A yarn center according to claim 13, further comprising a projection projecting into at least some of said slots, each projection acting as a spacer means for limiting a distance said longitudinal edge moves at said middle.

17. A yarn center according to claim 16, wherein said at least some of said slots include an additional projection to provide projections opposite each other to limit a movement of said longitudinal edges.

18. a yarn center according to claim 16, wherein said projections are thinner than a thickness of said wall, said projections being spaced inwardly from an outer surface of said wall.

* * * * *